United States Patent [19]

Westfall

[11] Patent Number: 4,779,380

[45] Date of Patent: Oct. 25, 1988

[54] SPRING COVER FRICTION SYSTEM FOR SASH BALANCE

[75] Inventor: Norman R. Westfall, Rochester, N.Y.

[73] Assignee: Caldwell Manufacturing Company, Rochester, N.Y.

[21] Appl. No.: 58,796

[22] Filed: Jun. 5, 1987

[51] Int. Cl.[4] ..... E05D 13/12

[52] U.S. Cl. ..... 49/430; 49/445

[58] Field of Search ..... 49/430, 429, 445, 446, 49/432

[56] References Cited

U.S. PATENT DOCUMENTS

| | | | |
|---|---|---|---|
| 2,593,658 | 4/1952 | Davis | 49/432 |
| 2,747,219 | 5/1956 | Haas | 49/430 |
| 3,482,354 | 12/1969 | Trout | 49/446 X |
| 3,499,248 | 3/1970 | Baer | 49/430 |
| 3,524,282 | 8/1970 | Kraft et al. | 49/445 X |
| 3,633,317 | 1/1972 | Koebel | 49/430 |
| 4,570,382 | 2/1986 | Suess | 49/430 |
| 4,571,887 | 2/1986 | Haltof | 49/429 |

*Primary Examiner*—Philip C. Kannan

*Attorney, Agent, or Firm*—Stonebraker, Shepard & Stephens

[57] ABSTRACT

An extruded resin jamb liner (10) has a spring cover (12) with a longitudinal slit (15) in which a platform (20) moves for balancing a sash. Platform (20) is a single piece resin part having a spring connector (30) inside the spring cover, a neck (24) extending through the slit, and a sash support (25) outside the spring cover. The platform also has inside and outside friction surfaces (26 and 27) respectively engaging inward and outward facing surfaces of the spring cover on opposite sides of the slit to provide a load-related frictional resistance against vertical movement of the platform in the slit.

18 Claims, 2 Drawing Sheets

SPRING COVER FRICTION SYSTEM FOR SASH BALANCE

BACKGROUND

Window balance systems using resin jamb liners with spring covers have generally limited the spring covers to the upper half of each jamb liner and have let sash platforms move up and down with the sashes in the bottom halves of the jamb liners where no spring covers interfere with platform movement. The Suess U.S. Patent 4,570,382 has suggested full length spring covers extending from top to bottom of the jamb liners with open vertical slots through which sash platforms can extend into adjustable friction shoes that ride up and down inside the spring covers. The spring covers require extra internal walls providing tracks for the friction shoes to work against.

Instead of an open slot and extra internal walls in a spring cover, as suggested by Suess, I have discovered a way that a platform can work with a spring cover that is simply slit so that the platform and the spring cover can achieve the friction necessary to prevent hop or drop of the balanced sash. My friction system not only uses a less expensive construction, but also provides a frictional resistance that is variable as a function of the spring force pulling up on the platform and the weight of a sash resting on the platform.

SUMMARY OF THE INVENTION

My friction system for a platform and spring cover is load responsive and applies to a sash balanced between resin jamb liners having a full length spring cover with a longitudinal slit. I use a single piece platform extending through the slit between a spring connection inside the spring cover and a support for a sash outside the spring cover. The platform has an inside friction surface engaging an inward facing surface of the spring cover on opposite sides of the slit and an outside friction surface engaging an outward facing surface of the spring cover on opposite sides of the slit. The inside friction surface is preferably spaced above the outside friction surface so that the spring force pulling upward inside the spring cover and the sash weight pushing downward outside the spring cover makes the friction surfaces press against the spring cover to resist vertical movement as a function of the spring force and the sash weight. Since the spring cover must be deformed to move the platform up or down in the slit, the resilient resistance of the spring cover to the required deformation combines with the frictional resistance to prevent hop or drop of the balanced sash.

DRAWINGS

DETAILED DESCRIPTION

Figure 1:
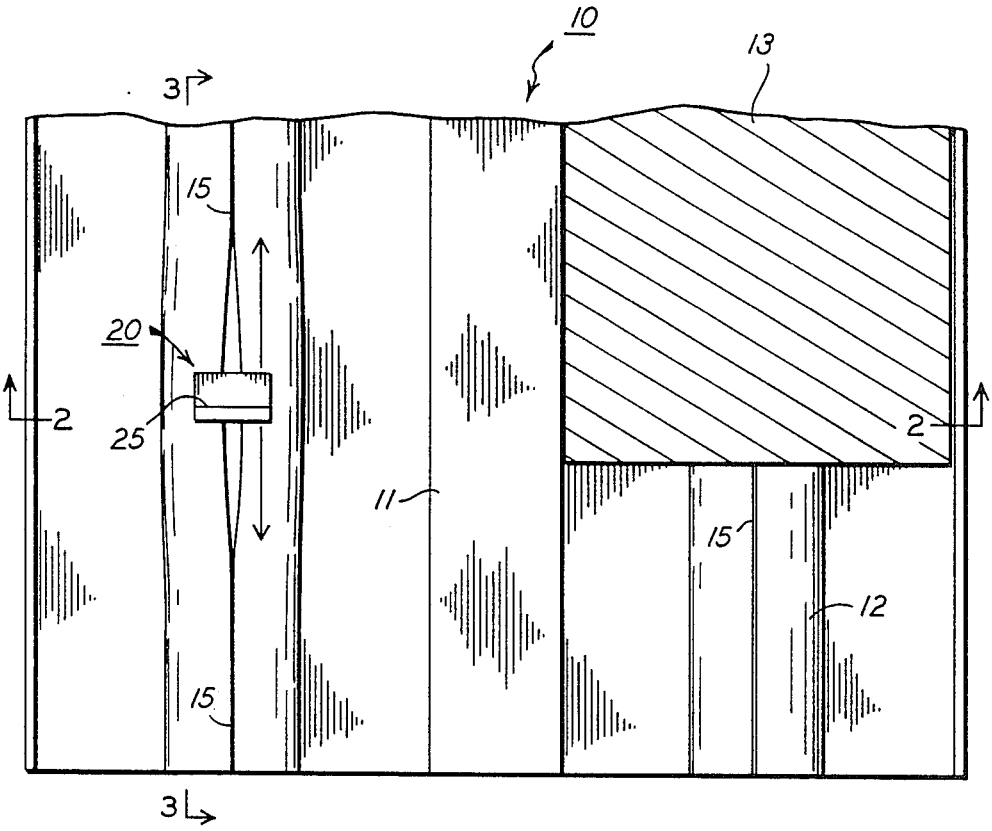
FIG. 1 is a fragmentary side elevational view of a preferred embodiment of my platform and spring cover friction system, showing a platform in one spring cover of a jamb liner.

My system applies to an extruded resin jamb liner 10 arranged on opposite sides of a balanced sash. For a double-hung window, jamb liner 10 includes a parting bead 11 separating a pair of sash runs, one of which contains a sash 13, and each of which has a spring cover 12. Usually these occupy only the upper half of each jamb liner, but for my friction system, one or two spring covers 12 extend the full length of jamb liner 10. This simplifies and reduces the expense of jamb liner extrusion, compared with the cutting away of spring covers in the lower half of a jamb liner or the adding of spring covers to an upper half.

Figure 2:
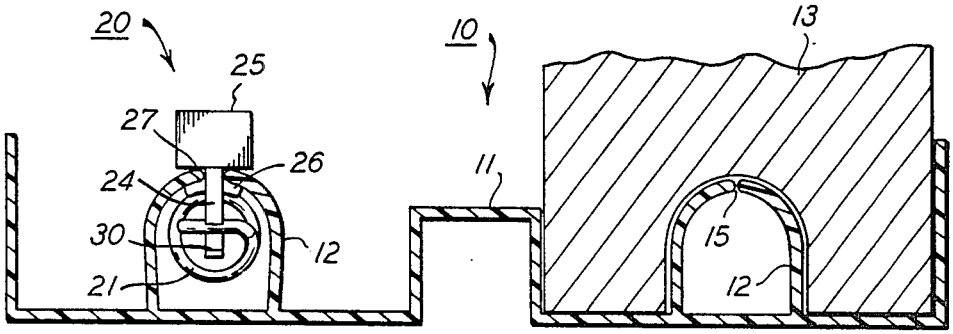
FIG. 2 is a lateral cross-sectional view of the system of FIG. 1, taken along the line 2—2 thereof.

During the extrusion of jamb liner 10, spring covers 12 are cut to form longitudinal slits 15, also extending from top to bottom of jamb liner 10. A simple knife arranged downstream of an extrusion die can form slit 15, and I prefer that the edges of the spring covers that confront at slit 15 be rounded, as best shown in FIG. 2. Although slit 15 can be formed to remain open, separating the longitudinal halves of spring cover 12, I prefer that these normally contact each other along slit 15. This helps keep dirt out of the inside of spring cover 12 and also adds to vertical movement resistance as explained below.

Platform 20 rides up and down in slit 15 in spring cover 12, as illustrated. Platform 20 is preferably injection molded of a single piece of resin material to form a sash support 25 extending outside of spring cover 12 and a spring connector 30 arranged inside of spring cover 12. A spring 21 connects to connector 30 at a hook 22 or hole through connector 30, and a sash rests its weight on support 25. A neck 24 between connector 30 and sash support 25 is relatively narrow and extends through slit 15. As platform 20 moves up and down spring cover 12, neck 24 spreads apart the halves of spring cover 12 at slit 15, as shown in FIG. 1. This deforms the spring cover halves laterally, requiring some force to change the vertical position of platform 20. At a short distance from platform 20, the edges of the longitudinal halves of spring cover 12 return to contact with each other along slit 15, again as shown in FIG. 1.

Figure 3:
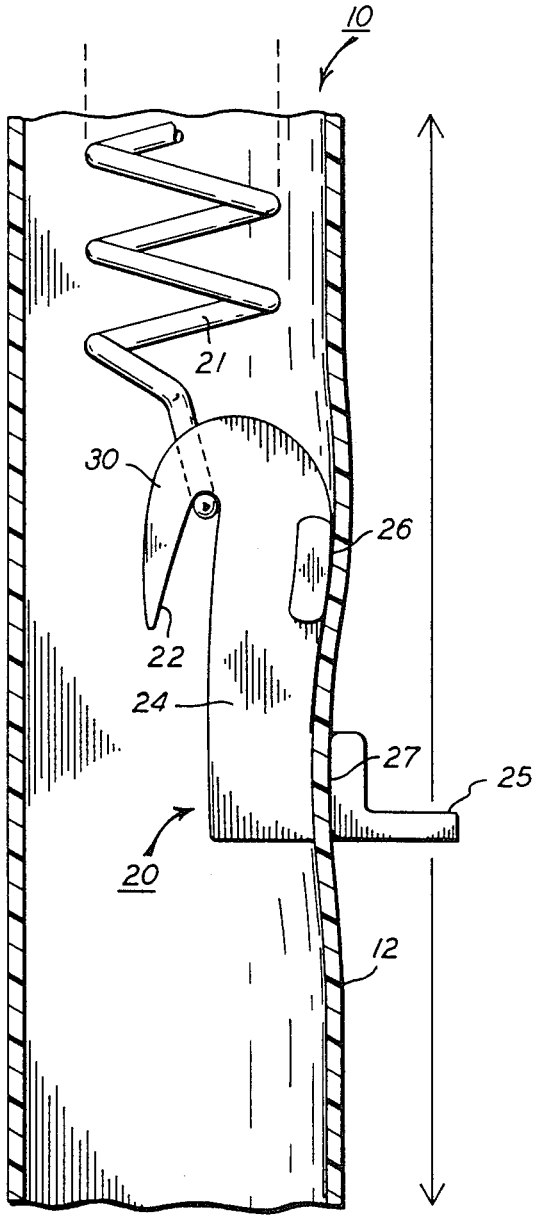
FIG. 3 is a vertical cross-sectional view of the system of FIG. 1, taken along the line 3—3 thereof.

An inside friction surface 26 on the spring connector side of neck 24 is wider than neck 24 and engages an inward facing inside surface of spring cover 12 on opposite sides of slit 15. An outside friction surface 27 engages an outward facing surface of spring cover 12 on the sash support side of neck 24. Since spring 21 pulls upward on platform 20 on the inside of spring cover 12, while the weight of a sash pushes downward on support 25 outside of spring cover 12, these opposing forces tend to tilt platform 24, as exaggerated in FIG. 3. This deforms the spring cover outward in an upper region where it is engaged by inside friction surface 26 and inward in a lower region where it is engaged by outside friction surface 27. The resulting S-curve deformation of spring cover 12 produces some resistance to vertical movement of platform 20.

Besides the spring cover deformation forces, friction surfaces 26 and 27 provide frictional resistance to moving platform 20 vertically along spring cover 12, and this frictional resistance is a function of the force of spring 21 and the weight of a sash resting on support 25. The friction forces created by surfaces 26 and 27, which are preferably rounded in the regions where they engage surfaces of spring cover 12, are thus load related and vary with changes in spring force and sash weight. These combine with the spring cover deformation forces to provide resistance to vertical movement, preventing hop or drop of the supported sash. Locating friction surfaces 26 and 27 vertically farther apart makes them less load responsive, and locating them vertically closer together makes them more load responsive.

I claim:

1. A load-responsive friction system for a sash balanced between resin jamb liners, said system comprising:

a. a spring cover of said jamb liners having a longitudinal slit;

b. a platform extending through said slit and having a connection to a spring system inside said spring cover and a support for said sash outside said spring cover;

c. an inside friction surface of said platform engaging an inward facing surface of said spring cover on opposite sides of said slit, and an outside friction surface of said platform engaging an outward facing surface of said spring cover on opposite sides of said slit; and d. said friction surfaces being pressed against said spring cover surfaces as a function of the force of said spring system urging said platform upward inside said spring cover and weight of a sash resting on said support outside said spring cover.

2. The system of claim 1 wherein said outside friction surface of said platform is spaced below said inside friction surface of said platform.

3. The system of claim 1 wherein edges of said slit in said spring cover are rounded.

4. The system of claim 1 wherein said friction surfaces of said platform extend laterally beyond a neck region of said platform extending through said slit.

5. The system of claim 1 wherein edges of said slit in said spring cover contact each other in regions spaced from said platform, and said edges are moved apart in the region of said platform.

6. The system of claim 1 where said inward and outward facing surfaces of said spring cover are on opposite sides of a wall of said spring cover.

7. The system of claim 1 wherein said spring cover is resiliently deformed in response to outward pressure from said inside friction surface and inward pressure from said outside friction surface.

8. A sash platform comprising:

a. a body having a connector connectable to a spring system, a neck, and a sash support capable of upholding the weight of a sash, said neck having a narrow width extending between said connector and said sash support;

b. said connector including a friction shoulder wider than said neck and arranged on a connector side of said neck to face toward said neck; and c. said sash support including a friction surface wider than said neck and arranged on a sash support side of said neck to face toward said neck and toward said friction shoulder.

9. The sash platform of claim 8 wherein said friction shoulder and said friction surface are spaced vertically apart.

10. The sash platform of claim 9 wherein said friction surface is below said friction shoulder.

11. The sash platform of claim 8 wherein a surface of said friction shoulder.

12. The sash platform of claim 8 wherein said body is injection molded of resin material.

13. A platform and spring cover friction system for a sash balanced between extruded resin jamb liners, said system comprising:

a. a spring cover of said jamb liners having a slit sparating and spring cover into two longitudinal and flexible halves;

b. said longitudinal halves being movable apart from each other to allow a platform to extend through said slit;

c. said platform having a sash support outside said spring cover and an outside friction surface engaging an outward facing surface of said spring cover on opposite sides of said slit;

d. said platform having an inside friction surface arranged inside said spring cover above said outside friction surface for engaging an inward facing surface of said spring cover on opposite sides of said slit; and e. said longitudinal halves being deformable in response to outward pressure from said inside friction surface and inward pressure from said outside friction surface.

14. The system of claim 13 wherein opposite edges of said slit are rounded.

15. The system of claim 13 wherein said platform is injection molded in a single piece body including said sash support, a neck extending through said slit, and a spring connector disposed inside said spring cover.

16. The system of claim 13 wherein said friction surfaces of said platform are rounded at regions of contact with said spring cover.

17. The system of claim 13 wherein said inward and outward facing surfaces of said spring cover are opposite sides of a wall of said spring cover.

18. The system of claim 13 wherein the friction of said friction surfaces engaging said spring cover is a function of the force of a spring engaging said platform inside said spring cover and the weight of a sash resting on said support outside said spring cover.

* * * * *